US005570554A

United States Patent [19]

Searer

[11] Patent Number: 5,570,554

[45] Date of Patent: Nov. 5, 1996

[54] INTERLOCKING STAPLED FLOORING

[75] Inventor: Floyd A. Searer, Elkhart, Ind.

[73] Assignee: FAS Industries, Inc., Elkhart, Ind.

[21] Appl. No.: 243,488

[22] Filed: May 16, 1994

[51] Int. Cl.[6] ..... E04B 1/02

[52] U.S. Cl. ..... 52/539; 52/541

[58] Field of Search ..... 52/480, 506.05, 52/539, 548, 535, 541, 546, 547

[56] References Cited

U.S. PATENT DOCUMENTS

| | | | |
|---|---|---|---|
| Re. 14,660 | 1/1919 | Dittmar . | |
| 1,764,331 | 1/1930 | Moratz . | |
| 1,986,739 | 1/1935 | Mitte | 52/539 |
| 2,021,577 | 11/1935 | Odell | 52/539 X |
| 2,088,238 | 7/1937 | Greenway . | |
| 2,266,746 | 12/1941 | Elmendorf | 52/539 X |
| 2,341,645 | 5/1944 | Muench . | |
| 3,828,493 | 8/1974 | Vezmar | 52/506.05 X |

FOREIGN PATENT DOCUMENTS

| | | | |
|---|---|---|---|
| 21854 | 8/1929 | Australia | 52/539 |
| 41970 | of 1925 | Norway | 52/539 |
| 237460 | 7/1925 | United Kingdom | 52/539 |

*Primary Examiner*—Carl D. Friedman
*Assistant Examiner*—Yvonne Horton-Richardson
*Attorney, Agent, or Firm*—Watson Cole Stevens Davis, PLLC

[57] ABSTRACT

A floor covering member with a bottom and a top cover surface for covering sub-flooring a first end portion extending between the top cover surface and the bottom surface, and having a blind attachment surface extending outwardly from the bottom surface and through which at least one fastening member is driven; the blind attachment surface having an end face; a step portion having an upper surface parallel to the top cover surface and extending upwardly from the blind attachment surface at a distance inwardly from the end face; a first edge portion extending from the top cover surface and forming a vertical wall extending downwardly from the top cover surface; a groove formed between the vertical wall and the upper surface of the step portion; a second end portion spaced between the top cover surface and the bottom surface and including a cove having an upper surface formed in the second end portion opposite the blind attachment surface; a tongue having a vertically stepped lower surface joining the upper surface of the cove and including another upper surface; a step portion extending upwardly from the another upper surface and a second edge portion sloping from the cover surface to the step portion.

6 Claims, 1 Drawing Sheet

INTERLOCKING STAPLED FLOORING

BACKGROUND OF THE INVENTION

1. Field of the Invention

This invention is directed to method and product for flooring, and in particular to floor members having a blind surface into which a nail or staple may be driven in substantially a vertical direction to attach the flooring member to a subfloor and more particularly to concrete, and which blind surface is covered by an interlocking portion of an abutting floor member, thereby resulting in a floor surface that is firmly attached to the subfloor and or concrete.

2. Related Art

A common method of fastening floor members is by chemical adhesives which may contain toxic or harmful chemical substances, thereby requiring at least aeration of the area to be surfaced. Other precautions such as the use of gloves and masks may also be required of the individual(s) laying the flooring surface. It is also conceivable that government regulations may preclude the use of such toxic chemical adhesives so that there is a need for improved structures and techniques in the floor fastening art.

The aforementioned restrictions on the use of chemical adhesives in the floor fastening art will undoubtedly result in a revival of fastening techniques for floors employing nailing into blind surfaces of the flooring member or tiles for their attachment to a sub floor surface. That such floor attachment techniques are well known is evident from the exemplary floor attachment techniques contained in the disclosure of the following U.S. Patents:

(1) U.S. Pat. No. RE 14,660; DITTMAR; "Flooring";

(2) U.S. Pat. No. 1,764,331; MORATZ; "Matched Hardwood Flooring";

(3) U.S. Pat. No. 2,088,238; GREENWAY; "Wood Flooring"; and (4) U.S. Pat. No. 2,341,645; MUENCH; "Tiling".

All of the above patents provide a blind surface into which a nail is driven in turn into a subfloor or other sub surface to attach the floor member thereto, and which blind surface is subsequently covered by another interlocking floor member. The floor installation techniques disclosed in each of these patents is deficient at least in that the floor member may be inadvertently damaged by being struck by a mis-directed hammer blow, for example. These prior art floor installation techniques also require that the head of the nail be driven below the surface of the blind surface to enable the matching portion of the abutting flooring member to properly mate with the blind surface containing the nail. Thus, these prior floor installation techniques are labor intensive and prone to damage of the flooring members, thereby impairing the resultant surface appearance of the finished floor and resulting in unnecessary cost in laying the floor.

In the patent to MEUNCH, the blind surface is provided on an extended tongue portion of the tile member in an attempt to reduce the probability of damage when the nail is driven into the inclined nailing surface 20, which is directly opposite beveled portion 24, thereby forming a groove construction 16 for accommodating tongue 15. The groove and tongue are appropriately notched so that the engaging surfaces of the tongue are received in the surfaces of the groove.

The length of the tongue and groove combination of the MEUNCH tile construction results in damage to the tongue, especially when the tile construction is used in flooring applications. Weight in the immediate area of the assembled groove and tongue may result in breakage of the tongue. This may explain why the MEUNCH patent disclosure emphasizes the use of the structure as a ceiling tile rather than as a floor tile.

All of the above prior art patents provide for the nail to be driven at an angle into the subfloor, and consequently none of these prior art floor members are useful in attaching floor members directly to a concrete subfloor as in such instances it is essential that the nail be driven substantially vertically into the concrete subfloor to avoid chipping the concrete and to obtain a solid joinder of the floor member to the concrete subfloor.

It is further noted that the prior art, and in particular the MEUNCH technique, does not utilize material efficiently as is evident from a consideration of the length of the tongue and groove structure.

SUMMARY OF THE INVENTION

Thus a primary object of the invention is to provide interlocking floor, ceiling or wall covering members having respective blind attachment surfaces and complementary-shaped groove and tongue portions, whereby the covering members may be attached to an appropriate surface without the use of adhesives and with a location of the blind surface on one of a pair of floor members or tiles that reduces or eliminates damage to the floor member or tile when the floor members are fastened to the floor surface by nailing or stapling into the blind surface.

Another object of the invention is that the complementary-edged surfaces of the covering members are easily milled to provide at least two surface edges that define the amount of engagement between the complementary covering members.

A feature of the invention is that covering members having oppositely disposed complementary-shaped edges and of the type specified herein have an end portion that may be easily stapled or nailed to an appropriate subfloor through a blind surface, and an opposing end portion having a complementary-shaped portion for engaging an abutting floor member, such that the opposing end portions of adjacently positioned covering members are in interlocked, abutting relationship so that the blind surfaces are completely covered and the abutting surfaces of the complementary floor members form a tight-fitting edge.

And yet another feature of the invention is that floor covering members having oppositely disposed, complementary-shaped edges, and of the type specified herein, respectively engage the edges of abutting covering members which include edge surfaces defining the depth of engagement of the abutting covering members to provide tightly abutting joint surfaces with respect to adjoining floor covering members.

A further feature of the invention is that the blind surface on each of the floor covering members is sufficiently exposed to enable a stabling gun or hammer to project a staple or nail, as the case may be, substantially vertically into the holding surface such as, for example, a concrete subfloor, ceiling or wall member without damaging the exposed surface of the covering members, while also enabling the edge surface of the floor member containing the blind surface to be in close abutting relationship with the engaging surfaces of the complementary edge portion of the adjacent floor or tile member. This improvement in the floor covering or tile member of the present invention greatly reduces the tendency of the covering member to be damaged when it is being laid on a floor surface.

When a floor covering is installed over concrete, if the fastener (nail or staple) enters the surface at any angle other than substantially 90 degrees, the concrete will chip out, thereby causing the fastener not to attach itself to maintain the floor covering member in place. In the MEUNCH patent the blind surface is at an angle which may cause the staple gun to set the fastener at an angle, causing the fastener to enter at other than a substantially ninety degree angle to the subfloor or concrete.

Yet another feature of the invention is that the design of the respective end portions of the floor covering members in accordance with the invention provides an efficient use of material as the length of the tongue and groove structure, for example, is limited in size, length and depth, as the case may be.

And still another feature of the invention is that floor covering members in accordance with the invention accommodate fasteners which are not completely set, allowing end portions of floor covering members to nest with their respective complementary end portions of adjacent floor covering members in nestled relationship even though the fasteners have not been completely set in place, i.e. the fasteners may protrude slightly above the blind surfaces.

BRIEF DESCRIPTION OF THE DRAWINGS

The above features, advantages and objects of the invention are readily apparent from the following description of a preferred embodiment of the invention representing the best mode of carrying out the invention when taken in conjunction with the following drawings, wherein.

DETAILED DESCRIPTION OF THE PREFERRED EMBODIMENT

Figure 1:
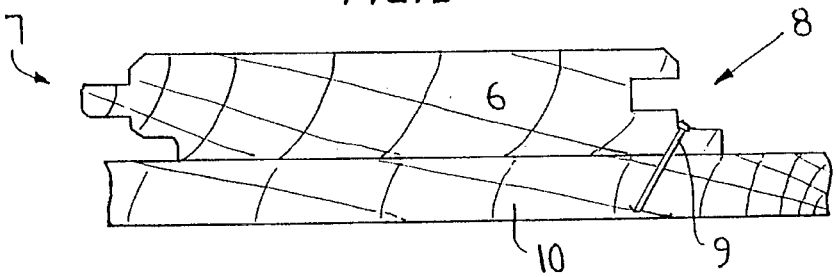
FIG. 1 illustrates an exemplary embodiment of a floor covering member, showing the respective complementarily-shaped end portions thereof, in accordance with the present invention.

FIG. 1 illustrates a side elevation view of a floor covering member 6 in accordance with the present invention and having respective end portions 7 and 8 which are complementary to one another so that floor covering members configured as shown in FIG. 1 may be assembled end-to-end to form a floor surface in a manner to be described herein. Floor covering members in accordance with the invention may be made of any material known to the floor covering art, but wood is the preferred material of the invention. In FIG. 1 fastener 9 is shown driven into wooden sub floor 10 at an angle through blind surface 11; however, the preferred technique of driving a fastener into a subfloor in accordance with the invention is to drive the fastener substantially vertically into the blind surface 20 and the subfloor 10, especially where the subfloor is made of concrete, as is more fully explained hereinafter.

Figure 2:
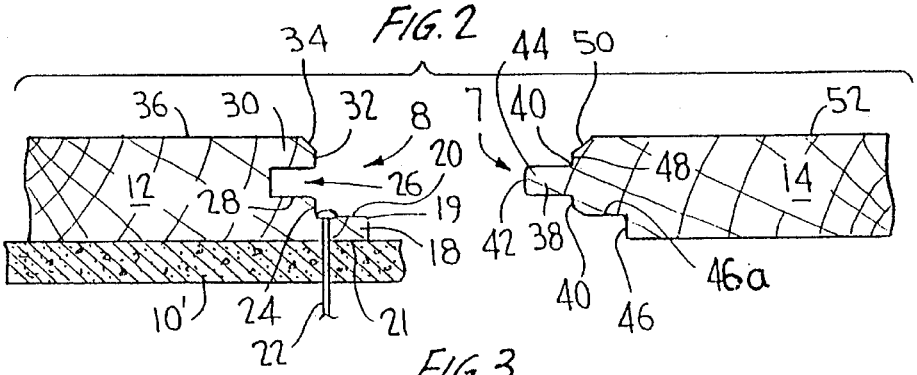
FIG. 2 illustrates the respective complementary end portions of two floor covering floor covering members in spaced relationship prior to being engaged in abutting, interleaving relationship with one another in accordance with a preferred embodiment of the invention.
Figure 3:
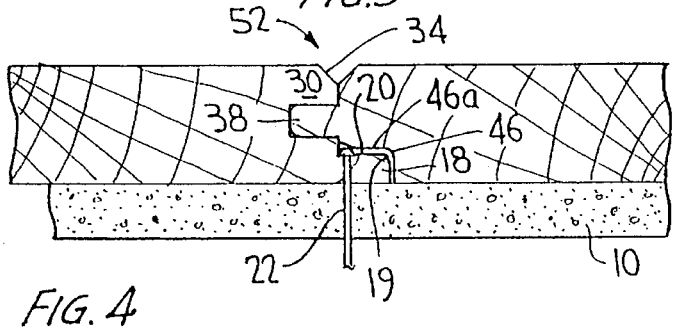
FIG. 3 illustrates the complementarily-shaped end portions of the covering members of FIG. 2 in abutting relationship.

FIG. 2 illustrates respective complementary-shaped end portions 7, 8 from respective floor covering members 14, 12, which are made to mate with one another in interlocking, closely abutting relationship as shown in FIG. 3. End portion 8 is formed with shelf-like projection 18 having a blind surface 20 into which a nail 22 (or staple) from a nail driving or staple driving gun (not shown) may be driven. Shelf-like projection 18 has a beveled edge 19 Nail 22 is preferably driven substantially vertically into the sub floor member 10' as shown in FIG. 2 to provide maximum holding force to attach the floor covering member 12 to the subfloor 10'. The bottom surface 21 of shelf-like projection 18 is flat so that the floor cover member 12 lies flat on the subfloor to provide a stable platform for driving the nail or staple 22 into blind surface 20.

Moreover, projection 18 and blind surface 20 extend outwardly from end portion 8 of floor covering member 12 to enable the nail or staple-driving machine to be placed in a substantially vertical position without engaging any of the other components of the end portion 8. The staple or nail is driven into blind surface 20, projection 18 and the subfloor 10' in a substantially vertical direction to provide maximum holding force for attaching the floor member 12 to the subfloor, and to avoid chipping the subfloor in the case where such subfloor is concrete. This is a distinct advantage over prior art floor members having a blind surface in which the nail or staple is required to be driven at an angle to avoid damage to those areas of the covering member adjacent the blind surface.

Extending upwardly from the blind surface 20 is a vertical wall member 24 which joins groove 26 formed in end portion 8 to form an edge 28. Projecting member 30 includes vertical extending wall member 32 and may include a beveled edge 34 sloping toward upper surface 36 of the floor covering member 12. Alternatively, edge 34 may be vertical. It is a significant feature of the invention that projection 30 does not overhang any portion of blind surface 20, thereby providing free vertical clearance above the blind surface, thereby enabling a stapling gun to be held substantially vertically.

End portion 7 of covering member 14 has structural features that are complementary to the structural features of end portion 8 of floor cover member 12 so that they will engage in closely abutting relationship as shown in FIG. 3. That is, the floor covering members in accordance with the present invention each have an end portion 7 and an end portion 8 with the various members thereof formed as shown in FIG. 1. The functions that are performed by the various shapes of the various members of the end portion 7 of covering member 14 in engaging in close abutting relationship with the complementary end portion 8 of an adjacent floor cover member 12 will be apparent from the following description of the various members of end portion 7.

Figure 5:
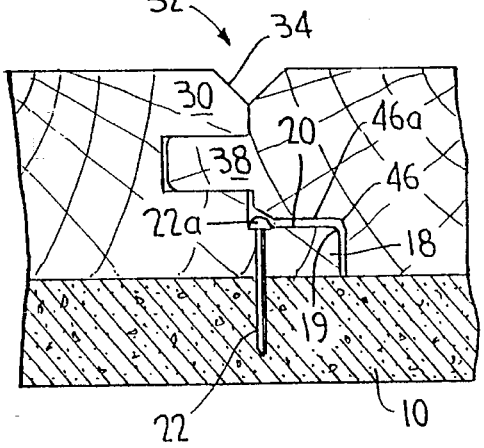
FIG. 5 is an enlarged view of the complementarily-shaped end portions of the covering members of FIG. 3 clearly showing the height of the cove with respect to the protruding nail or staple in the blind attachment surface.

End portion 7 includes tongue 38 projecting from vertical wall member 40. Tongue 38 is shaped to slide within groove 26 of end portion 8 of floor covering member 12 as shown in FIG. 3. Tongue 38 has rounded edges 42 and 44 to assist in the mating engagement of tongue 38 and groove 26. Vertical wall member 40 terminates at the upper surface **46*a* of cove 46, which conforms to the shape of blind surface 20** and beveled edge 19 of projection 18, whereby projection 18 is nestled within cove 46 with end portions 7 and 8 engaged in abutting relationship as shown in FIG. 2. The height of cove 46 is sufficient so that it will accommodate projection 18 with blind surface 20 of end portion 8 and a nail or staple that is slightly protruding above blind surface 20 when end portions 7 and 8 are mated (as shown more clearly in FIG. 5). Thus, in accordance with the invention, it is not necessary that the head of the fastener extend below the blind surface 20 to enable close engagement of the respective members of each of end portions 7 and 8. FIG. 5 is a detailed view of that portion of FIG. 3 showing the nestled relationship of projection 18 in cove 46 with a nail or staple 22 driven into blind surface 20 and into concrete floor 10. Cove 46 is sufficiently high to accommodate the protruding head **22*a* of nail or staple 22, thereby enabling the cove 46 and the projection 18 and blind surface 20** to be in nestled relationship.

Upper vertical wall member 48 terminates at downwardly sloping beveled edge 50. Beveled edge 50 extends between wall member 48 and the upper surface 52 of floor covering member 12.

Figure 4:
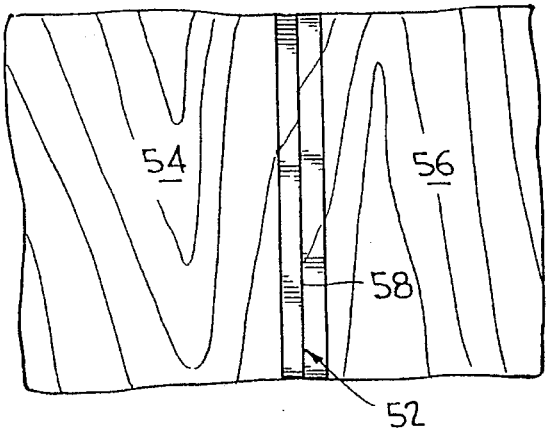
FIG. 4 is a top view of the covering members of FIG. 3, and showing the v-shaped channel formed along the abutting beveled edges of the abutting covering members.

As shown in FIG. 3, with the end portions 7 and 8 in close abutting relationship, vertical wall member 32 of edge portion 8 abuts closely against vertical wall member 48 of edge portion 7 so that beveled edges 34 and 50 form a v-shaped groove 52 as shown in FIGS. 3 and 4, and tongue 38 fits within groove 26 and projection 18 nestles within cove 46. The end portions 7 and 8 are not prevented from closely abutting against each other because of the above-described complementary relationship between the various members of each of the edge portions 7 and 8 as described above.

As shown in FIG. 4, the joining of two cover members 54 and 56 provides a beveled groove 52 with an abutting edge 58. A number of floor cover members may be so joined to provide a floor surface extending over any desired area. The upper surfaces of the floor members may be patterned or painted as desired.

In an alternative embodiment, as mentioned above, edges 34 and 50 (FIG. 3) may be vertical and not beveled, thereby forming a straight edge surface, as opposed to a beveled edge, when the floor members 54 and 56 are in abutting relationship.

Other features and modifications of the present invention are apparent from the foregoing description, and it is understood that the detailed specification and specific embodiment described herein, while setting forth a preferred embodiment of the invention, are given by way of illustration only, since various changes and modification within the spirit and scope of the appended claims will become apparent to those skilled in the art.

What is claimed is:

1. A floor covering member with a bottom and a top cover surface for covering sub-flooring, comprising:

a first end portion extending between said top cover surface and said bottom surface, and having a blind attachment surface extending outwardly from said bottom surface and through which at least one fastening member is driven; said blind attachment surface having an end face; a step portion having an upper surface parallel to said top cover surface and extending upwardly from said blind attachment surface at a distance inwardly from said end face; a first edge portion extending from said top cover surface and forming a vertical wall extending downwardly from said top cover surface; a groove formed between said vertical wall and said upper surface of said step portion; and a second end portion spaced between said top cover surface and said bottom surface and including a cove having an upper surface formed in said second end portion opposite said blind attachment surface; a tongue having a vertically stepped lower surface joining said upper surface of said cove and including another upper surface; a step portion extending upwardly from said another upper surface and a second edge portion sloping from said cover surface to said step portion.

2. A floor covering member according to claim 1, wherein said first edge portion and second edge portion have beveled edges.

3. A floor surface, comprising:

side-by side rows of floor covering members attached to a subfloor, each floor covering member having opposing complementarily-shaped first and second end portions and respective upper and lower surfaces;

first end portions of adjacent floor covering members engaging respective second end portions of adjacent floor covering members in tightly abutting relationship;

each said first end portion and said second end portion extending between the upper and lower surfaces of each said floor covering member;

each said first end portion including a blind attachment surface extending outwardly from the lower surface thereof and said blind attachment surface forming the means through which at least one fastener is driven into said sub-flooring; said blind attachment surface having an end face; a step portion having an upper surface parallel to the upper surface of said floor covering member and extending upwardly from said blind attachment surface at a distance inwardly from said end face; a first edge portion extending from said upper surface of said floor covering member and forming a vertical wall extending downwardly from said upper surface; a groove formed between said vertical wall and said upper surface of said step portion;

said second end portion including a cove having an upper surface formed therein opposite said blind attachment surface; a tongue having a vertically stepped lower surface joining said upper surface of said cove and including an upper surface; a step portion extending upwardly from said upper surface of said tongue member; and a second edge portion extending from said upper surface of said floor covering member to said step portion; and wherein with said first end portion and said second end portion in closely abutting relationship, said tongue is engaged within said groove with said stepped lower portion engaging said blind attachment surface, said blind attachment surface is nestled within said cove, and said vertical wall is closely abutted against said step portion to form a tight edge.

4. A floor surface according to claim 3, wherein said subfloor is concrete.

5. A floor covering according to claim 4, wherein at least one fastener is driven substantially vertically into said blind attachment surface and said subfloor.

6. A floor surface according to claim 3, wherein said first and second end portions are beveled and the tight edge formed between adjacent floor cover members in each of said rows is a channel.

* * * * *